US005153663A

United States Patent [19]

Bober et al.

[11] Patent Number: 5,153,663

[45] Date of Patent: Oct. 6, 1992

[54] PRINTING APPARATUS EMPLOYING A COMPLIANT SHEET CORRUGATING DEVICE

[75] Inventors: Henry T. Bober, Fairport; Frank C. Darling, Jr., Wolcott; Thomas W. Fletcher, Ontario, all of N.Y.

[73] Assignee: Xerox Corporation, Stamford, Conn.

[21] Appl. No.: 708,326

[22] Filed: May 31, 1991

[51] Int. Cl.[5] ..... G03G 21/00

[52] U.S. Cl. ..... 355/319; 271/188; 271/209; 355/308; 355/311

[58] Field of Search ..... 271/161, 188, 209; 355/309, 319, 308, 321, 311; 264/286, 287; 425/366, 368, 369

[56] References Cited

U.S. PATENT DOCUMENTS

| | | | |
|---|---|---|---|
| 3,929,327 | 12/1975 | Olson | 271/250 |
| 4,469,319 | 9/1984 | Robb et al. | 271/3.1 |
| 4,640,409 | 2/1987 | Holtman | 198/624 |
| 4,663,527 | 5/1987 | Koyama et al. | 271/161 X |
| 4,767,114 | 8/1988 | Nishimoto | 271/3 |
| 4,831,416 | 5/1989 | Bensen | 355/309 |
| 4,842,263 | 6/1989 | Robertson | 271/186 |
| 4,849,786 | 7/1989 | Murakami | 355/319 X |
| 4,893,806 | 1/1990 | McLaughlin | 271/272 |
| 4,901,117 | 2/1990 | Derrick | 355/309 |

FOREIGN PATENT DOCUMENTS

| | | | |
|---|---|---|---|
| 0109357 | 6/1983 | Japan | 271/188 |
| 0197267 | 8/1989 | Japan | 271/209 |

*Primary Examiner*—A. T. Grimley
*Assistant Examiner*—William J. Royer
*Attorney, Agent, or Firm*—William A. Henry, II

[57] ABSTRACT

A simple, low cost corrugation device for removing curl from sheets includes a compliant corrugator roll that is effective with light weight, low beam strength papers needing corrugation and passive with heavy weight, high beam stiffness papers not needing/not wanting corrugation. One type of corrugation roll is a cylindrical elastomeric roll made of a foam or sponge-like material. An alternative corrugator roll configuration is a hollow frustrum of a cone.

10 Claims, 2 Drawing Sheets

PRINTING APPARATUS EMPLOYING A COMPLIANT SHEET CORRUGATING DEVICE

BACKGROUND OF THE INVENTION

This invention relates to a copier/printer apparatus, and more particularly to a sheet corrugation system for use in such an apparatus.

In an electrostatographic reproducing apparatus commonly in use today, a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image areas contained within the usual document. Subsequently, the electrostatic latent image on the photoconductive insulating surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas in the photoconductive insulating area to form a powder image on the photoconductive area. This image may subsequently be transferred to a support surface such as copy paper to which it may be permanently affixed by heating or by the application of pressure. Following transfer of the toner image to a support surface, the photoconductive insulating member is cleaned of any residual toner that may remain thereon in preparation for the next imaging cycle.

Commercial applications of this apparatus have become increasing complex offering the users a variety of printing and copying options. One of the options of particular interest to a growing variety of customer applications is the capability for such machines to produce duplex prints and copies. By duplex copying or printing it is intended to define copies on which both sides of a single sheet are provided with fuser toner images. Another capability being provided in copying and printing machines with increasing frequency is that of being capable of providing two color or highlight color simplex, toner images on one side only of the copy or print. Both of these capabilities present significant problems in the handling of the copy substrates in an automatic printing or copying machine since the copy substrate on which the duplex image is formed or the second color or highlight color image is formed has already passed through the printing machine once to have the first toner image formed. In completing the first toner image the copy substrate is passed through a fuser which typically is at a temperature of about 400° F. to thereby raise the temperature of the thermoplastic toner material to a level at which it will coalesce and penetrate into the substrate, typically the paper fibers. As a result of this heating which is also typically performed in a heated roll fuser using both heat and pressure between the fuser roll and a pressure roll, the copy substrates are subjected to sufficient stress that they have a slight amount of curl or other nonplanar deformity resulting in poor stacking between adjacent sheets. As a result, the first produced copy substrates having fused toner images thereon when collected in a duplex tray within the printing machine for subsequent duplex or second color reproduction do not stack the way virgin copy substrates stack but rather stack with nonuniform gaps or air pockets between adjacent copy substrates. This tendency of such copy substrates to fluff creates feeding difficulties in sheet feeders used to feed the copy substrates from the collection tray for the second pass through the printing or copying apparatus.

The problem of properly repeated restacking a series of documents one after another in a copier document stacking tray for duplexing purposes is much more than a problem in free fall dynamics. The trajectory of the documents must be controlled without damage or wearing the documents so that the documents consistently travel to and hit the proper landing area and stops flat in the aligned stack position so that they can be subsequently recaptured by the feeder and refed to be recirculated past the platen of the copier for copying at the proper position (alignment) on the platen. Document sheet restacking is affected by factors including especially the sheet's release point, cantilever (unsupported length), velocity, mass, stiffness, and "air foil" shape including both induced and accidental curls on one or both axis of the sheet. Original documents are typically flimsy sheets which easily and typically change shape when released for restacking from air resistance, air flow lift, preset curl tendencies, etc. All of these characteristics affect the "flight" of the document being restacked and its settling position. The restack trajectory problem also applies to copies directed to a duplex tray for refeeding in order to receive second side images.

Attempts at answering the heretofore mentioned curl problems when feeding copy sheets as well as documents have resulted in the development of a particular sheet feeder in U.S. Pat. No. 4,901,117 and a document restacking system in U.S. Pat. No. 4,469,319 that includes automatic variable corrugation stacking means in the form of flexible deflector tabs and flexible finger-like members.

Other patents of interest include U.S. Pat. No. 4,842,263 which discloses a sheet reversing apparatus which employs a buckle chamber and input and output rollers which, together with a common roller, serve to form input and output nips for conveying a sheet into and out of the buckle chamber to reverse the lead and trail edge orientation thereof. The trail edge of the sheet is urged forward to become engaged by foam rollers which transfer the sheet from the input nip to the output nip.

U.S. Pat. No. 4,640,409 discloses a conveyor device for conveying sheet material by utilizing two pairs of parallel conveyor rollers, each pair including a deformable and a non-deformable roller. The deformable rollers are provided with a soft covering of rubber which increases the frictional property of the rollers to increase the speed of the fed sheets. The degree of deformation is dependent on the stiffness of the sheets passing through the rollers.

U.S. Pat. No. 4,767,114 discloses a sheet feeder which has a slip preventing mechanism consisting of a deformable member whose tip projects from a drive discharge roller and bends in contact with a sheet to be discharged and forcibly discharges the sheet into a small area. Transfer is conveniently attained without having the ink smearing or staining the transferred sheet.

U.S. Pat. No. 3,929,327 discloses a document transport and registration apparatus comprising an idler roller and a frusto-conical drive roller which cooperate with one another to advance a document along a predetermined path. The cone shaped drive roller is flexible so that it may radially deform when advancing the document, whereby a misaligned sheet is automatically brought into alignment with a guide edge.

U.S. Pat. No. 4,893,806 discloses a pinch roller device to be used in automatic teller machines which eliminates misfeeding of deposit envelopes. A pinch roller is located between frame members above a foam-like drive roller for a conveyor belt. The pinch roller serves to provide pressure to the foam roller so that slack is eliminated and even bulky envelopes can be properly fed through the conveyor belts.

U.S. Pat. No. 4,831,416 discloses a sheet advancing apparatus for an electrophotographic printing machine in which a rotatably mounted member cooperates with a rotatably mounted polyhedron which creates a nip through which sheets are fed. Transport rolls are made from foam so light-weight and heavy copies can be easily conveyed forward. The rolls provide the correct amount of pressure to different thickness sheets by virtue of their composition. This arrangement improves the prior art where rigid transport rolls are spring mounted to resiliently urge the sheets forward.

All of the above-mentioned references are included herein by reference.

While some of the above-mentioned patents do eliminate some of the unwanted curl in sheets that are to be duplexed, as well as, original documents, that are to be recirculated, they are not entirely satisfactory.

SUMMARY OF THE INVENTION

Accordingly, a sheet corrugating device is disclosed that controls the curling of lightweight copy sheets while allowing passive travel of stiffer copies. The corrugating device includes a corrugating roll which is either cylindrical and elastomeric or a hollow frustrum of a cone which by virtue of its geometry allows less lateral disturbance of the copy sheets or documents. The cylindrical roll preferably is of a low durometer, such as, a foam sponge.

Various of the above-mentioned and further features and advantages will be apparent from the examples described hereinbelow of specific apparatus and steps of operation. The invention will be better understood by reference to the following description of one specific embodiment thereof, which includes the following drawing figures (approximately to scale) wherein:

DETAILED DESCRIPTION OF THE PREFERRED EMBODIMENT

The invention will now be described with reference to a preferred embodiment of the sheet corrugation device of the present invention and printing apparatus embodying the same.

Figure 1:
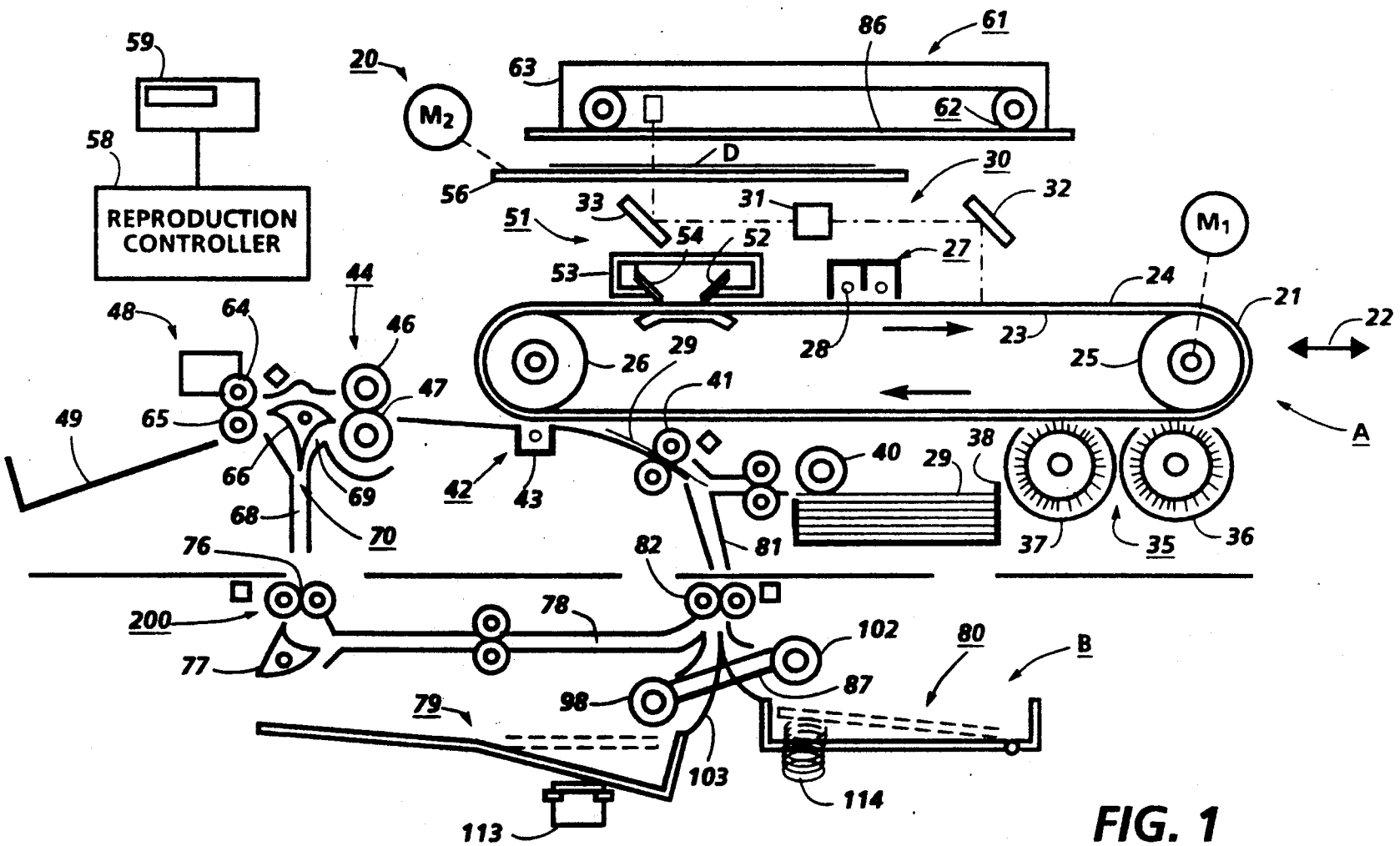
FIG. 1 is a schematic representation in cross section of an automatic printing, machine which includes the copy sheet corrugation device of the present invention.

The reproducing machine depicted in FIG. 1 illustrates the various components utilized therein for producing copies from an original document. It should become evident from the following description that the invention described herein is equally well suited for use in a wide variety of processing systems including other reproduction systems, and is not necessarily limited in application to the particular embodiment or embodiments shown herein. For example, the corrugation device of the present invention could be used equally well in recirculating document handlers (RDH).

The printing machine 20 illustrated in FIG. 1 employs a removable processing cartridge 21 which may be inserted and withdrawn from the main machine frame in the direction of arrow 22. Cartridge 21 includes a belt like photoreceptor member 23, the outer periphery of which is coated with a suitable photoconductive material 24. The belt is suitably mounted for revolution within the cartridge about driven transport rolls 25 and 26, and travels in the direction indicated by the arrows on the inner run of the belt to bring the image bearing surface thereon past the plurality of conventional xerographic processing stations. Suitable drive means such as motor $M_1$ are provided to power and coordinate the motion of the various cooperating machine components whereby a faithful reproduction of the original input image information is recorded upon a copy sheet 29, such as a paper or the like.

Initially, photoreceptor 23 is passed through a charging station 27 wherein photoreceptor 23 is uniformly charged with an electrostatic charge placed on the photoconductive surface 24 by charge corotron 28 in a known manner preparatory to imaging. Thereafter photoreceptor 23 is exposed to the light from the input image whereby the charge is selectively dissipated in the light exposed regions to record the input image in the form of electrostatic latent image. The document is scanned with a multi mirror scanning optics system 30 including stationary lens 31 and a pair of cooperating movable scanning mirrors 32, 33. The scanning mirrors include a half rate mirror 32 and a full rate mirror 33 supported on carriages (not shown) for scanning movement. Multi mirror scanning system 30 is of a type well known in the art. A suitable development station 35 could include a magnetic brush development system, including developer roll 36, utilizing a magnetizable developer mix having coarse magnetic carrier granules and toner colorant particles. Means may be provided to select among a choice of colored toners to apply images onto copy sheets in different colors. This is illustrated by a second developer roll 37 for a second color.

Paper sheets 29 are supported in a stack arrangement on elevated stack support tray 38. With the stack at its elevated position, the sheet separator feed roll 40 feeds individual sheets therefrom to the registration pinch roll pair 41. Individual sheets are forwarded to the transfer station 42 in proper registration with the image on the belt, and the developed image on the photoconductive surface 24 is brought into contact with a copy sheet 29 within the transfer station 42, and the toner image is transferred from the photoconductive surface 24 to the contacting side of the copy sheet 29 by means of transfer corotron 43. Following transfer of the image, the copy sheet, which may be paper, plastic etc., as desired, is separated from photoreceptor 23 by the beam strength of copy sheet 29 as it passes around the curved face of photoreceptor 23 around the transport roller 26 and the copy sheet containing the toner image thereon is advanced to fusing station 44 wherein the transferred powder image is affixed to the copy sheet by being transported between an internally heated fuser roll 46 in contact with the toner image and backup pressure roll 47. After fusing the toner image to the copy sheet, copy sheet 29 is advanced to the reversible exit nip 48 from where it may be directed to sheet stacking tray 49 or to the input of a sorter (not shown) or directed to the duplex path. Copy sheets can also be forwarded to the transfer station from auxiliary tray 80 by feed roll 102 mounted on toggle member 87. A spring 114 lifts copy sheets up to the proper feeding position for feeding by feed roll 102.

Although a preponderance of toner is transferred to the copy sheet 29, invariably some residual toner remains on the photoconductive surface 24 after the transfer of the toner image to the final support material or copy sheet. The residual toner particles remaining on the photoconductive surface after the transfer operation are removed form the belt 23 by the cleaning station 51 which comprises a cleaning blade 52 in scrapping contact with the outer periphery of the belt 23, and contained within cleaning housing 53 which has a cleaning seal 54 associated with the upstream opening of the cleaning housing. Alternatively, the toner particles may be mechanically cleaned from the photoconductive surface by a cleaning brush as is well known in the art.

When the copier is operated in the conventional mode, original document D to be reproduced is placed on platen 56 which is scanned by multi mirror scanning optics 30 which directs light from the document to the photoreceptor 23 for copying. The speed of photoreceptor 23 and scanning optics 30 are synchronized to provide for accurate reproduction of the document. Platen 56 is preferably large enough to support at least two $8\frac{1}{2}\times 11$ inch documents disposed on the platen with their long edges adjacent in side-by-side relationship. Servo motor $M_2$ drives scanning optics 30 in its motion by platen 56 and is controllable by the reproduction processor controller 58 to selectively scan platen 56, whereby only a portion of a selected document on the platen is copied. Additionally, while in normal copying operation the scanning optics are moved along a path from a home position to a position required to complete exposure of a document to be copied, servo motor $M_2$ is also controllable to provide repeated copying of such document, and returning scanning optics 30 to a "start of scan" position other than a normal home position for such copying.

Reproduction processor controller 58 is preferably a known programmable controller or combination of controllers, which conventionally controls all of the other machine steps and functions described herein including the operation of the document feeder, the paper path drives in both the reproduction processor A and duplex module B etc.. The controller 58 also conventionally provides for storage and comparisons of counted values including copy sheets and documents, and numbers of desired copies, and control of operations selected by an operator through alphanumeric display and control panel 59.

An automatic document feeder 61 is optionally provided and is controllable by the reproduction processor controller 58. Documents are fed by belt 86 into the device at document input 62 and are passed across platen 56 for copying, and exit the feeder at document output 63.

It is believed that the foregoing general description is sufficient for the purpose of the present application to illustrate the general operation of an automatic xerographic copier which can embody the apparatus in accordance with the present invention. It will be appreciated that while the present invention finds particularly advantageous use with respect to the described arrangement, the principles of operation may be used in many other embodiments.

With continued reference to FIG. 1, the duplex module and paper path are illustrated. The reversible exit nip 48 is provided with a motor (not shown) for driving roller 64 in forward, reverse and stop motion. The motor may advantageously be a stepper motor of the sort well known in the art. Reproduction processor controller 58 instructs the motor to drive the drive roller 64 of the exit nip 48 as required by the copying function in process. Thus, for simplex copying of a document, or completed duplex copying of a document, roller 64 is driven in a forward direction to drive copy sheet to output tray 49 thereby serving as an output driver. In the case where the copy sheet is required to receive a second side image for a duplex copy, roller 64 is driven first in a forward direction until the copy sheet trail edge has cleared deflector 70, and subsequently in reverse direction to drive the copy sheet back into reproduction processor A through the duplex module. The process of changing direction while the copy sheet is in exit nip 48 serves to change the trail edge of the copy sheet to the lead edge to enable inversion of the document to receive a second side copy. In certain cases, it will be desirable to hold a copy sheet while the processor advances previously returned copy sheets in order to correctly time the return of all the copy sheets to the processor for receiving a second image. In this case, roller 64 is stopped and the copy sheet is held between rollers 64, 65 until a control signal is received from controller 58 by the motor, directing it to drive the paper in either forward or reverse motion.

In operation, reversible exit nip 48 receives the copy sheet between rollers 64 and 65 from the exit nip of fuser station 44. The copy sheet is passed thereinbetween until the trailing edge clears the deflector 70 from the fuser 44 and the duplex module copy sheet path 68. Deflector 70 is situated slightly higher than the reversible exit nip, and extends into the paper path 69 to block the returning copy sheets and direct them to the duplex path 68.

When image merging copying (two images or colors on the same side) is desired reversal of the copy sheet lead and trail edges is not required, and deflector 70 is pivoted about an axis closing access to keep copy sheets from entering reversible exit nip 48, and creates a path leading directly from copy sheet path 69 to duplex module copy sheet path 68. Copy sheets passed through the duplex module in this manner are returned to the reproduction processor presenting the same side for copying as was presented the first time through. Thus, either a new image or a colored image may be overlayed thereon.

As seen in FIG. 1, copy sheets to receive a second image thereon are passed downwardly from the deflector 70 along duplex module copy sheet path 68. For the purpose of description, these sheets will be assumed to be receiving an image on the second side thereof, and will be described as such, although it will be appreciated that such sheets could be receiving a second image overlayed on the first side image. Where appropriate, the image merging process will be mentioned with particularity. Advantageously, the duplex module B may be placed in a drawer which is movable into and out of position under processor A in a direction perpendicular to the plane of FIG. 1. The drawer may therefore be pulled outwardly from the front of the machine.

Copy sheets are passed from the reversible exit nip 48 past the concave deflector surface 66 via duplex paper path 68 to duplex module entry nip 76 which pass the copy sheet into the duplex module B. On passing duplex module entry nip 76, sheets are passed to duplex deflector baffle 77. Duplex deflector baffle 77 serves to direct copy sheets to either trayless path 78 or duplex tray 79. Deflector baffle 77 is controllable in response to reproduction processor controller 58, in accordance with the copying functions the operator has selected. When duplex deflector baffle 77 is in place to block entry of copy sheets into the trayless path 78, such copy sheets are directed into duplex tray 79. Copy sheets which are passed to duplex tray 79 are refed therefrom by feed roll 98 along chute 103 to reproduction processor duplex entry path 81 through duplex module exit nip 82 to re-enter the reproduction processor 20 for receiving a second side copy. A leaf spring 113 biases the copy sheets into engagement with feed roll 98.

As mentioned hereinbefore, when duplexing is required, the copy sheets that are fed to the duplex tray for refeeding from the duplex tray to receive images on their second or back side, have been heated to a temperature of about 400° F. in order to fuse the first or front side image to the sheets. This fusing stress causes an amount of curl in the sheets that must be accommodated during stacking of copy sheets in the duplex tray if successful refeeding from the duplex tray is to be accomplished without misfeeding, multifeeding or jamming of the copy sheets occurring. Therefore, a corrugation device 200 is positioned as shown in FIG. 1 that overcomes or suppresses the curl in copy sheets with one side imaged while the copy sheets enter duplex tray 79. Corrugation is a well recognized and effective method of dealing with curl in copy sheets in stacking and restack situations in duplex trays, finishing stations, catch trays and document handlers. Corrugation is typically most needed with lighter weight papers due to their greater likelihood to curl severely after fusing. Corrugation is usually not needed and often not desired with heavier papers (i.e. >20 lb. basic weight) due to creasing or marring of the copy paper. Typical solutions are to spring load the corrugating rolls so as to permit the higher stiffness of heavier papers to decrease the corrugation penetration and eliminate copy sheet damage. Proper design of the system compliance allows corrugation to be effective for curl control for 13–16 and 20 lb. copy but reasonably passive for heavier paper weights. This characteristically can require multiple springs, extra shafts, and additional guides and supporting structures for the floating corrugators.

Figure 2:
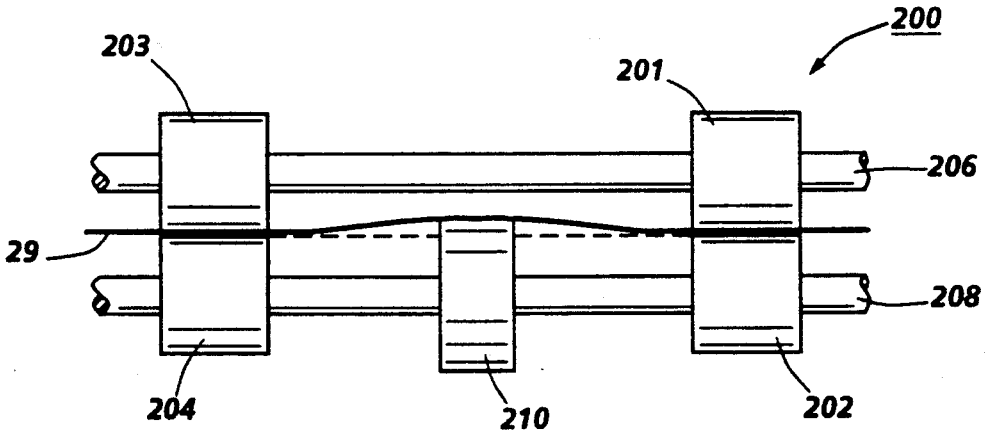
FIG. 2 is a partial, enlarged end view schematic of the copy sheet corrugation device of FIG. 1 incorporating an elastomeric corrugation roll with light weight (low stiffness) copy sheets.
Figure 3:
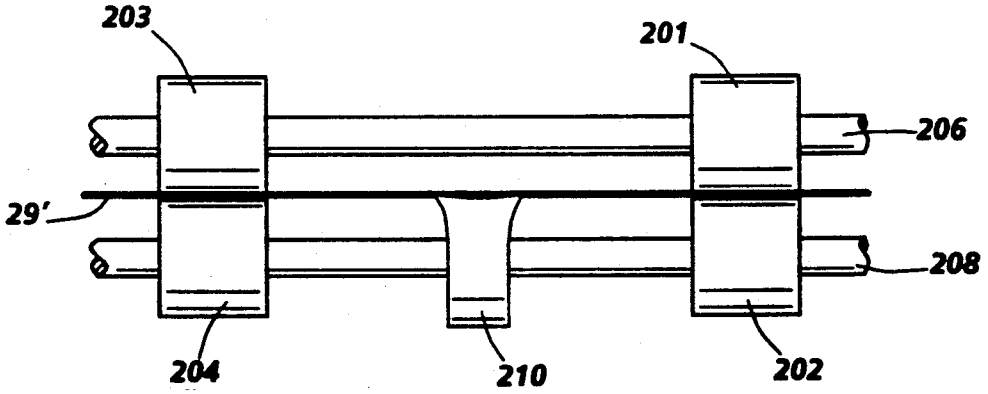
FIG. 3 is a partial, enlarged end view schematic of the copy sheet corrugation device of FIG. 2 used with heavy weight (high stiffness) sheets.

An improved corrugation device 200 is disclosed that compensates for the heretofore mentioned drawbacks by employing a compliant corrugator roll 210 as shown in FIGS. 2 and 3. Corrugator roll 210 is a pure cylindrical elastomeric roll with desired radial compliance due to the elastomer's low durometer. The roll could be made of foam or sponge-like material. To avoid speed differentials, a low coefficient of friction or skinned roll is preferred or molding the roller on plastic sleeves to permit the corrugator roll to free wheel against the paper surface. The corrugation device 200 includes two pinch shafts 206 and 208 having drive rolls 202 and 204 complimented in pinch fashion by idler rolls 201 and 203 mounted thereon to form sheet transport nips. Interspersed, alternating and interpenetrating elastomeric corrugation rolls 210 mounted on shaft 208 are provided that are inherently compliant and thus do to require more complex compliant mounting systems or additional parts, thereby making the device cheaper to assemble, use fewer parts and more efficient than the corrugation systems mentioned heretofore.

Compliant corrugator roll 210 is effective with light weight, low "beam strength" papers, yet is easily overpowered by stiffer, heavy weight papers not needing corrugation and answers the old problem of how to control curl in light weight papers for duplex restack and RDH restack yet be passive with stiffer papers. For example, FIG. 2 depicts the configuration that lightweight sheet 29 would adopt when passing through corrugation device 200 en route to duplex tray 79. The amount of deflection of sheet 29 by corrugator roll 210 is shown with reference to the dotted line in the FIG. In FIG. 3, corrugator roll 210 is shown deformed by heavy weight sheet 29' where corrugation of the sheet is not required because its "beam strength" resisted curl after it left the fuser.

Figure 4A:
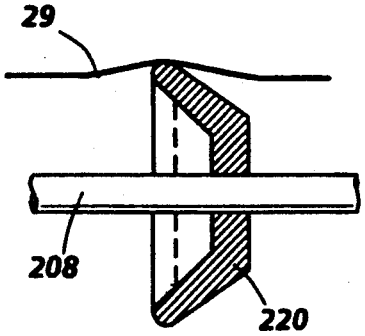
FIGS. 4A and 4B are partial, enlarged side views of a schematic of an alternative copy sheet corrugation device of the present invention employing a frustro-conical corrugation member. The frustro-conical corrugation member is used with light weight (low stiffness) sheets in FIG. 4A and with heavy weight (high stiffness) sheets in FIG. 4B.
Figure 4B:
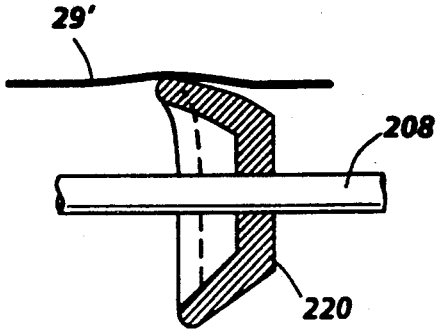

In an alternative embodiment of the present invention in FIGS. 4A and 4B, hollow frustrum of a cone 220 is shown as the corrugator member which preferably molded out of a compliant elastomer. The operation and function of the corrugator member 220 is the same as corrugator 210 with the additional benefit that the geometry of corrugator 220 makes the directional buckling nature of the rolls collapse offers less variation in lateral disturbance of the sheets. Also, the design configuration makes its compliance (buckling, collapse) less material dependent. As seen in FIG. 4A, light weight sheet 29 deflects corrugator 220 much less than heavy weight sheet 29' in FIG. 4B since corrugation of light weight sheets is desired to remove curl while corrugation of heavy weight sheets is not desired because they resist curl due to their weight and "beam strength".

Thus, according to the present invention, a device is provided which enables the refeeding of substrates having fused toner images thereon to an electrostatographic printing machine for a second or subsequent pass which does not suffer from the difficulty associated with sheets which have already passed through an electrostatographic fuser system. This is accomplished by providing low durometer elastomeric corrugation rolls or hollow cone-shaped rolls in a corrugation device to remove sheet curl from light weight sheets while allowing heavy weight sheets to overpower the device and not be corrugated.

While the invention has been described with references to specific embodiment it will apparent to those skilled in the art that many alternatives, modifications and variations may be made. For example, while the invention has been illustrated with reference to a printing machine wherein an electrostatic latent image is formed by optically scanning an original, it will be appreciated that the electrostatic latent image may be created in other ways such by a modulated beam of light from a laser beam. Accordingly, it is intended to embrace all such modifications and alternatives as may fall within the spirit and scope of the appended claims.

We claim:

1. A sheet corrugation device for removing curl from sheets passing therethrough, comprising:

a first shaft;

a plurality of drive rolls mounted on said first shaft for rotational movement;

a second shaft;

a plurality of idler rolls mounted for rotational by and in nip forming contact with said plurality of drive rolls; and compliant, deformable corrugator rolls positioned in interspersed relationship between and on the same shaft with said plurality of drive rolls for corrugating light weight sheets while not corrugating heavy weight sheets.

2. The sheet corrugation device of claim 1, wherein said compliant, deformable corrugator rolls are made of a foam material.

3. The sheet corrugation device of claim 1, wherein said compliant, deformable corrugator rolls are hollow and frustrum conical shaped.

4. The sheet corrugation device of claim 1, wherein said compliant, deformable corrugator rolls are cylindrical shaped and made of a foam-like material.

5. The sheet corrugation device of claim 1, wherein said compliant, deformable corrugator rolls are made of an elastomeric-like material.

6. In a printing apparatus that employs a duplex tray to receive simplexed copy sheets and refeed them to a processor for duplexing of the copy sheets, the improvement of a copy sheet corrugation means for removing curl from the copy sheets en route to the duplex tray is characterized by:

a first shaft;

a plurality of drive rolls mounted on said first shaft for rotational movement;

a second shaft;

a plurality of idler rolls mounted for rotational by and in nip forming contact with said plurality of drive rolls; and compliant, deformable corrugator rolls positioned in interspersed relationship between and on the same shaft with said plurality of drive rolls for corrugating light weight sheets while not corrugating heavy weight sheets.

7. The improvement of claim 6, wherein said compliant, deformable corrugator rolls are made of a foam material.

8. The improvement of claim 6, wherein said compliant, deformable corrugator rolls are hollow and frustrum conical shaped.

9. The improvement of claim 6, wherein said compliant, deformable corrugator rolls are cylindrical shaped and made of a foam-like material.

10. The improvement of claim 6, wherein said compliant, deformable corrugator rolls are made of an elastomeric-like material.

* * * * *